United States Patent [19]

Mezger et al.

[11] Patent Number: 4,700,478

[45] Date of Patent: Oct. 20, 1987

[54] KNIFE FOR CUTTING THROUGH THE ADHESIVE THAT FASTENS A WINDOW PANE IN PLACE

[75] Inventors: Dieter Mezger, Weinheim; Georg Harsch, Stuttgart; Gert Flachenecker, Leonberg, all of Fed. Rep. of Germany

[73] Assignee: C.& E. Fein Gmbh & Co., Stuttgart, Fed. Rep. of Germany

[21] Appl. No.: 722,605

[22] Filed: Apr. 12, 1985

[30] Foreign Application Priority Data

Aug. 2, 1984 [DE] Fed. Rep. of Germany ... 8423004[U]

[51] Int. Cl.[4] ..... B26B 29/00

[52] U.S. Cl. ..... 30/294; 30/314; 29/239

[58] Field of Search ..... 30/2, 164.9, 294, 295, 30/329, 334, 314, 337, 342, DIG. 8, 272, 271; 29/235, 239

[56] References Cited

U.S. PATENT DOCUMENTS

| | | | |
|---|---|---|---|
| 519,250 | 5/1894 | Fearn | 30/295 X |
| 2,681,502 | 6/1954 | Black | 30/2 |
| 3,613,134 | 10/1971 | Bassett | 30/2 |
| 3,990,144 | 11/1976 | Schwartz | 30/DIG. 8 X |
| 4,199,852 | 4/1980 | Ayers et al. | 29/239 |
| 4,215,475 | 8/1980 | Moroford et al. | 30/272 R |
| 4,543,720 | 10/1985 | Grunkiewicz | 30/272 R |

FOREIGN PATENT DOCUMENTS

| | | | |
|---|---|---|---|
| 762292 | 1/1934 | France | 30/295 |
| 480654 | 2/1938 | United Kingdom | 30/295 |

*Primary Examiner*—Paul A. Bell
*Assistant Examiner*—William Fridie, Jr.
*Attorney, Agent, or Firm*—Max Fogiel

[57] ABSTRACT

A knife to be mounted in an oscillating tool for cutting through the adhesive that fastens a window pane in place, especially in a motor vehicle. To reduce the risk of damage to its edge and to the window frame or other areas of the vehicle body, the knife has a rest made out of a soft material, especially plastic, associated with at least one side of the blade.

9 Claims, 8 Drawing Figures

KNIFE FOR CUTTING THROUGH THE ADHESIVE THAT FASTENS A WINDOW PANE IN PLACE

BACKGROUND OF THE INVENTION

The present invention relates to a knife to be mounted in an oscillating tool for cutting through the adhesive that fastens a window pane in place, especially in a motor vehicle. The window panes, especially the windshields, of contemporary motor vehicles are fastened to the body with adhesive in order to improve resistance to wind, etc. When the panes are damaged and need to be replaced it becomes necessary to cut through the layer of adhesive, which is sometimes very thick and tough. This be done by hand unsatisfactorily or not at all. Oscillating tools that allow the layer to be cut through in one rapid operation have accordingly been developed and eliminate any problems in replacing the panes, at least with respect to cutting. It has, nevertheless, turned out that the oscillating knife cannot be guided along the layer of adhesive and tends to slip out laterally, resulting in damage to the window frame or other areas of the body. A malfunction of this type can of course also damage the edge of the knife if it encounters metal.

SUMMARY OF THE INVENTION

The object of the present invention is to improve a knife of the aforesaid type to the extent that the risk of damage to its edge and to the window frame or other areas of the vehicle body is at least decreased.

This object is attained in accordance with the invention in that the knife to be mounted in an oscillating tool for cutting through the adhesive that fastens a window pane in place, especially in a motor vehicle, has a rest made out of a soft material, especially plastic, associated with at least one side of the blade. The application of a rest made out of a soft material, especially plastic, to the blade allows the blade to be guided along the window frame and, in case it does slip out laterally, to be insulated from the usually metal frame or other areas of the body, preventing the aforesaid damage. Another advantage is that the avoidance of metal-to-metal contact considerably reduces the level of noise.

The rest must be positioned on the blade where it will not only reliably guide and insulate it but also allow the layer of adhesive to be cut through, meaning in particular that it will not impede the insertion of the blade into the layer of adhesive when the operation is initiated. If a rest is positioned on only one side of the blade and if the rest is not resting against the window frame when the cutting operation is initiated, the knife must be manipulated in such a way that, if it does slip out, it will slip out at the side that the rest is positioned on.

In one embodiment of the invention, in which the knife is doglegged as viewed from the edge, forming a tang and a cutting section, the rest is mounted on the cutting section. The cutting section extends at a slight angle, about 15° for example, to the tang. The rest matches the cutting section, especially the area of the cutting section that it is attached to, in both shape and dimensions, thickness for example. The attachment must be strong enough to resist the stresses encountered in oscillation. The plastic that the rest is made out of must have enough mechanical strength to resist any mechanical stresses that occur. In other words, the life of the rest must correspond to the greatest extent possible to that of the knife or its blade. The knife can in a known way be double-edged. It can be made out of a high-quality knife steel that hardens satisfactorily. The "soft material" for the rest is to be understood as a plastic that is softer than the materials that the knife and the surface that the adhesive adheres to are made out of.

In one variation of this embodiment, the rest is at the free end of the blade and the free end tapers. The blade or the area of the blade that the rest is mounted in is about ½ to 1 cm wide. The rest can be just as wide and can even be somewhat wider than the blade at the point where the rest is attached to it.

In another variation that is edged at the free end, the rest is a roller or pin positioned more or less at the end of the preferably thicker portion of the blade, which lacks an edge. The rest constitutes a sort of depth guide to support and guide the knife throughout the cutting process.

In this variation the outer diameter of the rest can be slightly longer than the width of the blade at the point where the rest is attached to it. Specifically, it can project at each side. When the side of the blade tapers continuously, it will naturally be wider toward the tang end than the outer diameter of the rest, as illustrated in the drawing.

In another variation the rest is a plastic jacket around part of the blade or of the intermediate section of the blade. Such a rest will support the knife at either side, not just one side.

In a second embodiment of the invention, in which the knife is shaped more or less like the letter U as viewed from the edge, with a tang and a cutting section, the rest is positioned on a section between the cutting section and tang, especially in the vicinity of the cutting section. It is practical in this case, especially if the rest is attached to only one side of the blade, for the transition from the circumference of the rest into the surface of the cutting section to extend continuously along the arc of a circle.

In this embodiment of the invention the rest can be a cylindrical elevation or bead associated with the surface of the intermediate section of the more or less U-shaped knife. The curvature of the elevation or bead can match or be identical to the radius of curvature of the cutting section.

In another variation the portion of the intermediate section that the rest is mounted on is thinner than the remaining portions of the intermediate section and the thinner portion and rest together are as thick as or slightly thicker than the remaining portions of the intermediate section.

Depending on its resilience and size, the rest, especially when it is a cylindrical elevation, can be more or less resiliently compressed. When, accordingly, the rest or the top of the elevation projects slightly when the knife is unstressed, the extent of the projection can more or less equal the extent that the rest is compressed to when the knife is in operation. These dimensions are only slight, on the order of 1 or 1/10 mm.

In still another and preferred variation the rest is a plastic jacket around a portion of the intermediate section that can in particular be thinner than the remaining portions of the section. The thickness in this case as well is on the order of 1 mm, with the blade approximately as thick. When the intermediate section is not thinner or when the rest is associated with a portion of the intermediate section that is not thinner, the dimensions will be somewhat different, with either the portion of the intermediate section that is not thinner or the tang itself being about 2 mm thick.

Some preferred embodiments of the invention will now be described with reference to the attached drawings, wherein

DETAILED DESCRIPTION OF THE PREFERRED EMBODIMENTS

The blade of the knife in accordance with the invention has a rest 4 or 5 of a material that is essentially softer than that of the blade on at least one side 3, the side facing away from the observer in FIGS. 1, 3, 5, and 7 for example. The material that the rest is made out of is in particular plastic. The rest 6 or 7 in the embodiments or variations illustrated in Figures through 8 is on both sides of the blade, jacketing a prescribed section of the knife. Positioning two rests next to each other or having a rest in more than one piece is also conceivable for special applications when practical in terms of the shape of the window frame or pane.

Figure 2:
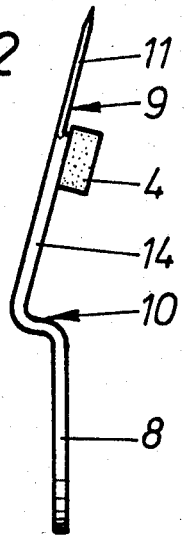
FIG. 2 is an edge-on view of the embodiment illustrated in FIG. 1 subsequent to being angled.
Figure 1:
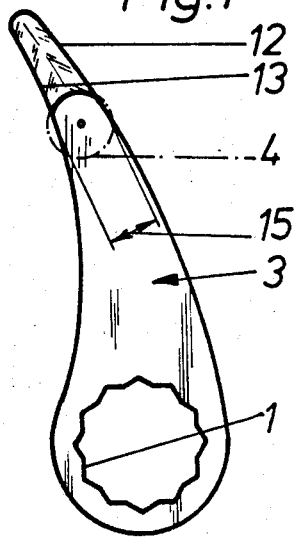
FIG. 1 is a side view of one embodiment of the invention.

The knife illustrated in FIG. 2 is doglegged as viewed from the edge, forming a tang 8 and a cutting section 9 with an intermediate 10 between them. Tang 8 is provided with a mounting aperture 1 and serves for mounting the knife in an oscillating cutting tool, not illustrated. Cutting section 9 extends in a plane that is at an acute angle of approximately 15° to that of tang 8. Cutting section 9 is also stepped down to make it thinner. Thinner portion 11 is rounded off at the point and has two cutting edges 12 and 13. At the transition between the thicker portion 14 and the thinner portion 11 of cutting section 9 is a rest 4, which is a roller or pin in this variation. It consists for example of polyamide and is preferably fastened to the knife with a rivet, especially an aluminum rivet. As will be evident from FIG. 1 the diameter of rest 4 is slightly longer than the blade or than the thicker portion 14 of the blade is wide at the point where the rest is attached. The rest can also be mounted farther into the thicker portion and the transition between the thicker and thinner portions can be smooth instead of in the form of a step.

The embodiment of the knife in accordance with the invention illustrated in FIGS. 3 through 8 is in the shape of a U as seen from the edge.

Figure 4:
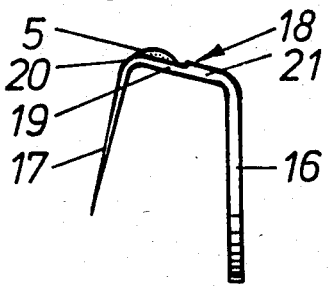
FIG. 4 is an edge-on view of the embodiment illustrated in FIG. 3 subsequent to being angled.
Figure 3:
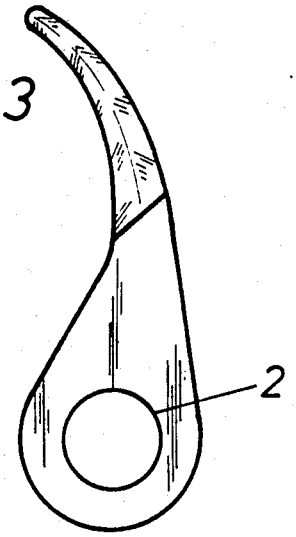
FIG. 3 is a side view of another embodiment of the invention.
Figure 5:
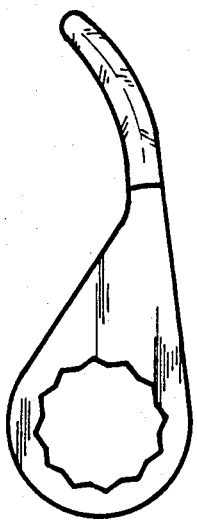
FIG. 5 is a side view of one variation of the invention.

It also consists of a tang 16 and, in FIG. 4, of a cutting section 17 with an intermediate section 18 between them. Cutting section 17 is stepped down like the cutting section 9 in FIG. 2 to make it thinner. A rest 5 in the form of a bead is associated with the thinner portion 19 of intermediate section 18. It merges smoothly along the arc 20 of a circle from intermediate section 18 to cutting section 17. Rest 5 and thinner portion 19 together are approximately as thick or slightly thicker than the thicker portion 21 of intermediate section 18. The transition between thicker portion 21 and thinner portion 19 can also either be smooth or over a short intermediate wedge-shaped piece. It is also possible to mount rest 5 on thicker portion 21.

Figure 6:
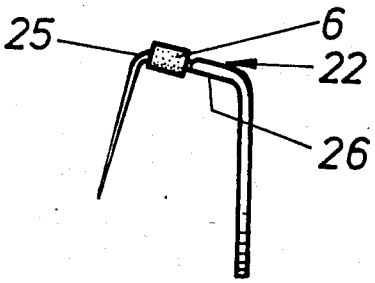
FIG. 6 is an edge-on view of the variation illustrated in FIG. 5 subsequent to being angled.
Figure 7:
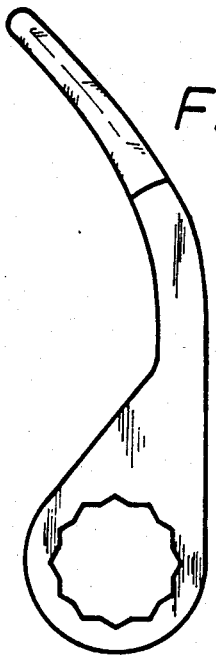
FIG. 7 is a side view of another variation.
Figure 8:
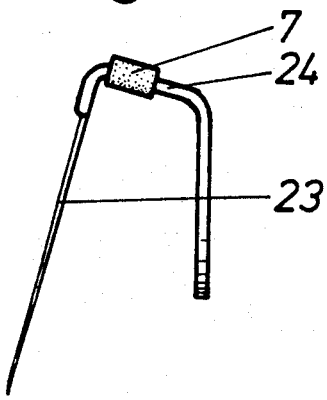
FIG. 8 is an edge-on view of the variation in FIG. 7 subsequent to being angled.

The rest 6 or 7 in the variations illustrated in FIGS. 6 and 8 is in the form of a plastic jacket. The knife illustrated in FIG. 6 is stepped down thinner at intermediate section 22 and the knife in FIG. 8 at cutting section 23. The rest 7 in FIG. 8 is mounted on intermediate section 24 toward cutting section 23 and to some extent thickens the intermediate section. The rest 6 in FIG. 6, on the other hand, is mounted on the thinner portion 25 of intermediate section 22 and its surface is approximately flush with that of thicker portion 26 or elevated slightly, to the extent of its potential compress for example, above it.

The present specification and claims are of course intended solely as illustrative of one or more potential embodiments of the invention and should not be construed as limiting it in any way. The invention may accordingly be adapted and modified in many ways without deviating from the theory behind it or exceeding its scope of application. In particular, that all the embodiments of and variations on the invention described herein are angled as seen from the edge shall not be construed as implying that the knife cannot also exist in straight embodiments, as illustrated in FIGS. 1, 3, 5, and 7, or in curved embodiments. Furthermore, the overall shape of the polygonal aperture 1 or round aperture 2 for mounting the knife is to be understood as strictly illustrative because not absolutely essential to the invention. Finally, the outer contours of the knife as evident from FIGS. 1, 3, 5, and 7 are to be considered as representing only the general principles of the design and subject to differentiation as desired, which is why the contours are not exactly identical from figure to figure.

We claim:

1. A knife blade for mounting in an oscillating tool to cut through adhesive fastening a window pane to a window frame, particularly in a motor vehicle; a rest member mounted on said mode and compossed of a soft plastic material for guiding the blade along the window frame free of contact therewith for reducing noise levels, said blade having a tang portion and a cutting said tang portion adapted to be mounted on said oscillating tool; said cutting portion having a thin, tapered free end cutting section and an intermediate non-cutting section; said rest member being mounted adjacent the juxture of said free end section and said intermediate section.

2. A knife blade as defined in claim 1, wherein said blade has doglegged shape when viewed from an edge.

3. A knife blade as defined in claim 2, wherein said rest member comprises a plastic jacket around part of said blade.

4. A knife blade as defined in claim 1, wherein said rest member comprises a member having a substantially circular-shape.

5. A knife blade as defined in claim 4, wherein said rest member has an outer diameter substantially greater than the width of the blade at a point where said rest member is attached to said blade.

6. A knife blade as defined in claim 1, wherein said tang portion and said cutting portion forming a substantially U-shape with said intermediate section, said tang and said cutting portions comprising legs of said U-shape and said tang, particularly in vicinity of the cutting section.

7. A knife blade as defined in claim 6, wherein said rest member comprises a cylindrical projection or bead associated with a surface of an intermediate section of a substantially U-shaped blade.

8. A knife blade as defined in claim 7, wherein said intermediate section has a portion mounting said rest member, said portion being thinner than remaining portions of said intermediate section, said thinner portion and rest member together being at least as thick as the remaining portions of said intermediate section.

9. A knife blade as defined in claim 6, wherein said rest member comprises a plastic jacket around a portion of said an intermediate section. 7

* * * * *